US005757256A

United States Patent [19]

Vilou

[11] Patent Number: 5,757,256

[45] Date of Patent: May 26, 1998

[54] STARTER AND CONTACTOR THEREFOR

[75] Inventor: Gérard Vilou, Tassin, France

[73] Assignee: Valeo Equipements Electriques Moteur, Creteil, France

[21] Appl. No.: 661,721

[22] Filed: Jun. 11, 1996

[30] Foreign Application Priority Data

Jun. 12, 1995 [FR] France ..... 95 07046

[51] Int. Cl.[6] ..... H01H 62/02

[52] U.S. Cl. ..... 335/126; 335/131

[58] Field of Search ..... 335/126, 131

[56] References Cited

U.S. PATENT DOCUMENTS 3,284,742 11/1966 Pettit et al. .
4,644,179 2/1987 Pointout et al. .
4,801,909 1/1989 Fasola ..... 335/126

FOREIGN PATENT DOCUMENTS 0 15 983 2/1985 European Pat. Off. .
2 193 845 7/1986 United Kingdom .

OTHER PUBLICATIONS

French Search Report 1 Mar. 19961.

*Primary Examiner*—Lincoln Donovan
*Attorney, Agent, or Firm*—Morgan & Finnegan, L.L.P.

[57] ABSTRACT

A starter for a motor vehicle, of the kind having a contactor provided with a movable contact able to be moved in translation between an idle position, in which the contact bears against a fixed conductive element and towards which it is forced by elastic return means, and an active position in which the movable contact establishes the electrical connection between a current input terminal, and a terminal supplying the starter motor, of the kind in which means are provided which, when the movable contact is in the idle position, enable an electrical contact to be established between the supply terminal and the electrical earth of the vehicle, the movable contact and the supply terminal being connected electrically by elastic return means made of a conductive material.

1 Claim, 3 Drawing Sheets

STARTER AND CONTACTOR THEREFOR

BACKGROUND OF THE INVENTION

The invention concerns a starter for a motor vehicle.

The invention relates more particularly to a starter for a motor vehicle, of the kind having a contactor provided with a movable contact able to be moved in translation by electromagnetic means between an idle position, in which the contact bears against a fixed conductive element connected to the electrical earth of the vehicle, and towards which it is forced by elastic return means, and an active position in which the movable contact establishes an electrical connection between a current input terminal, connected to the positive terminal of the battery of the vehicle, and a terminal supplying the starter motor, of the kind in which means are provided which, when the movable contact is in the idle position, enable an electrical contact to be established between the supply terminal and the electrical earth of the vehicle through the movable contact, and of the kind in which the elastic return means are arranged between the movable contact and a support block for the terminals which is made from an insulating material.

Electrical earthing of the terminal supplying the motor as soon as the contact established by the movable contact is interrupted is known.

This is because such an arrangement allows efficacious and rapid braking of the rotor of the starter motor.

Thus the starter motor, which includes an induction winding and an armature winding connected electrically in series is in electrical short-circuit when the supply terminal is connected to the electrical earth of the vehicle.

The rotor of the starter motor is then braked by self-induction.

To ensure that this device functions correctly, it is, however, necessary for the earthing of the supply terminal to be interrupted when the starter motor is operated, otherwise a short-circuit will be caused.

It has already been proposed to use for this purpose the movable contact, whose position is representative of the state, fed or otherwise, of the supply terminal, so as to earth the supply terminal when it is in the idle position.

However, the devices proposed to date make the assembly of the components of the contactor difficult, and exhibit problems of reliability.

The invention therefore aims to propose a device for earthing the supply terminal which is easy to assemble and which offers perfect operating guarantees.

SUMMARY OF THE INVENTION

The invention provides a starter of the kind referred to above in which the movable contact and the supply terminal are connected electrically by elastic return means made of conductive materials.

According to other characteristics of the invention:

the elastic return means include a helical compression spring made of a conductive material bearing through a first axial extremity against the movable contact and through its second extremity against a metal connection lug connected to the supply terminal;

the contactor has a substantially cylindrical casing, closed off at one axial extremity by the support block for the terminals which has an annular skirt for centering and fixing onto the casing and a transverse bottom, each of the terminals has a contact head arranged against the transverse bottom and a connection stud which opens axially into the external face of the transverse bottom, the return spring is arranged axially in the contactor and it is guided at its second axial extremity in a substantially cylindrical housing formed substantially at the center of the transverse bottom;

the metal lug has a first extremity which is received in the housing and against which the second extremity of the return spring bears axially, and a second extremity which is connected to the first by a bent connection strip, which has a hole in it for the passage of the connection stud of the supply terminal, the second extremity is clamped between the contact head of the supply terminal and the internal face of the transverse bottom of the block.

The invention also proposes a contactor for a starter in accordance with the disclosures of the invention.

Other characteristics and advantages of the invention will emerge from a reading of the detailed description which follows, for an understanding of which reference should be made to the accompanying drawings.

DETAILED DESCRIPTION OF THE PREFERRED EMBODIMENTS

Figure 1:
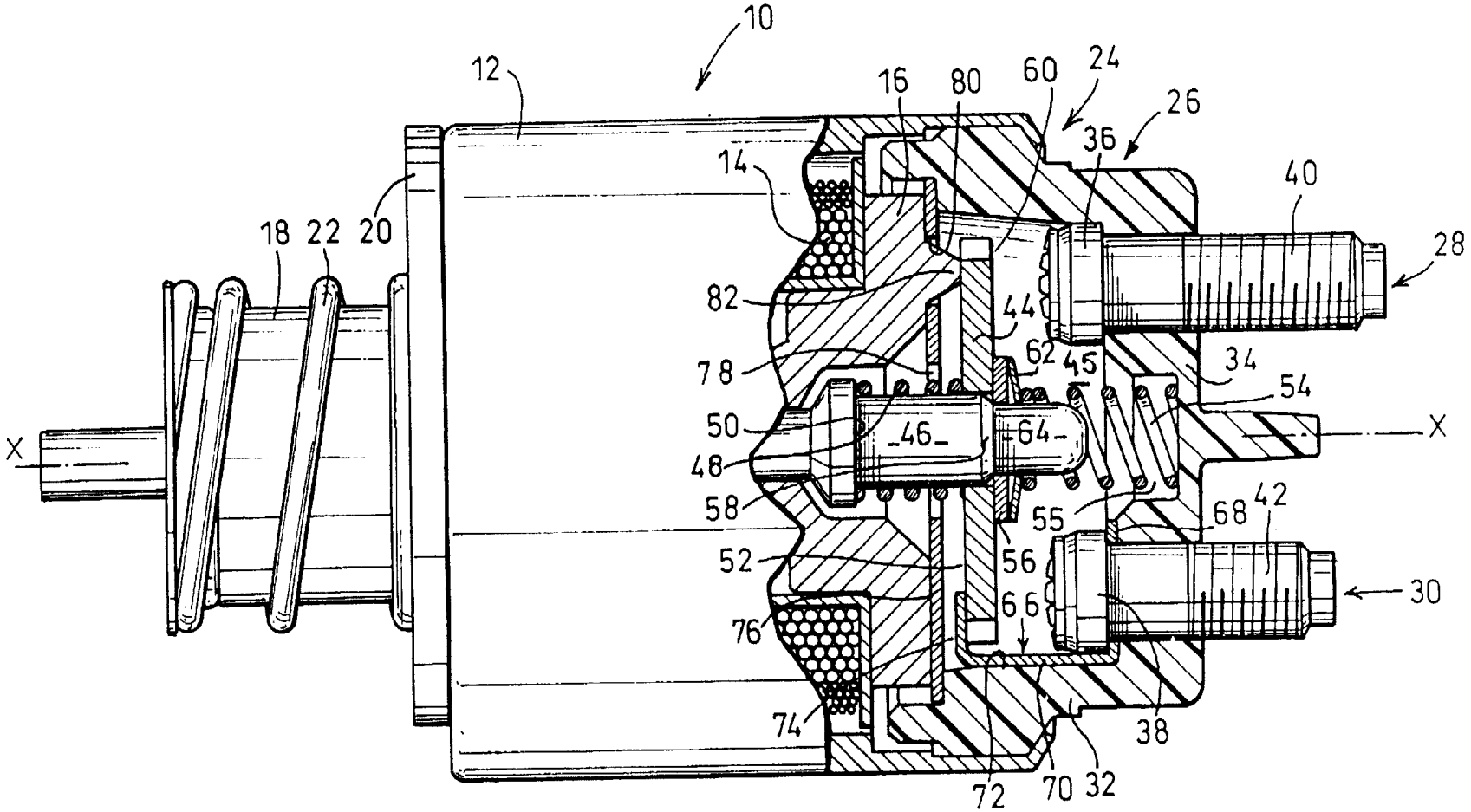
FIG. 1 is a depiction in partial axial section of a starter contactor according to the prior art.
Figure 2:
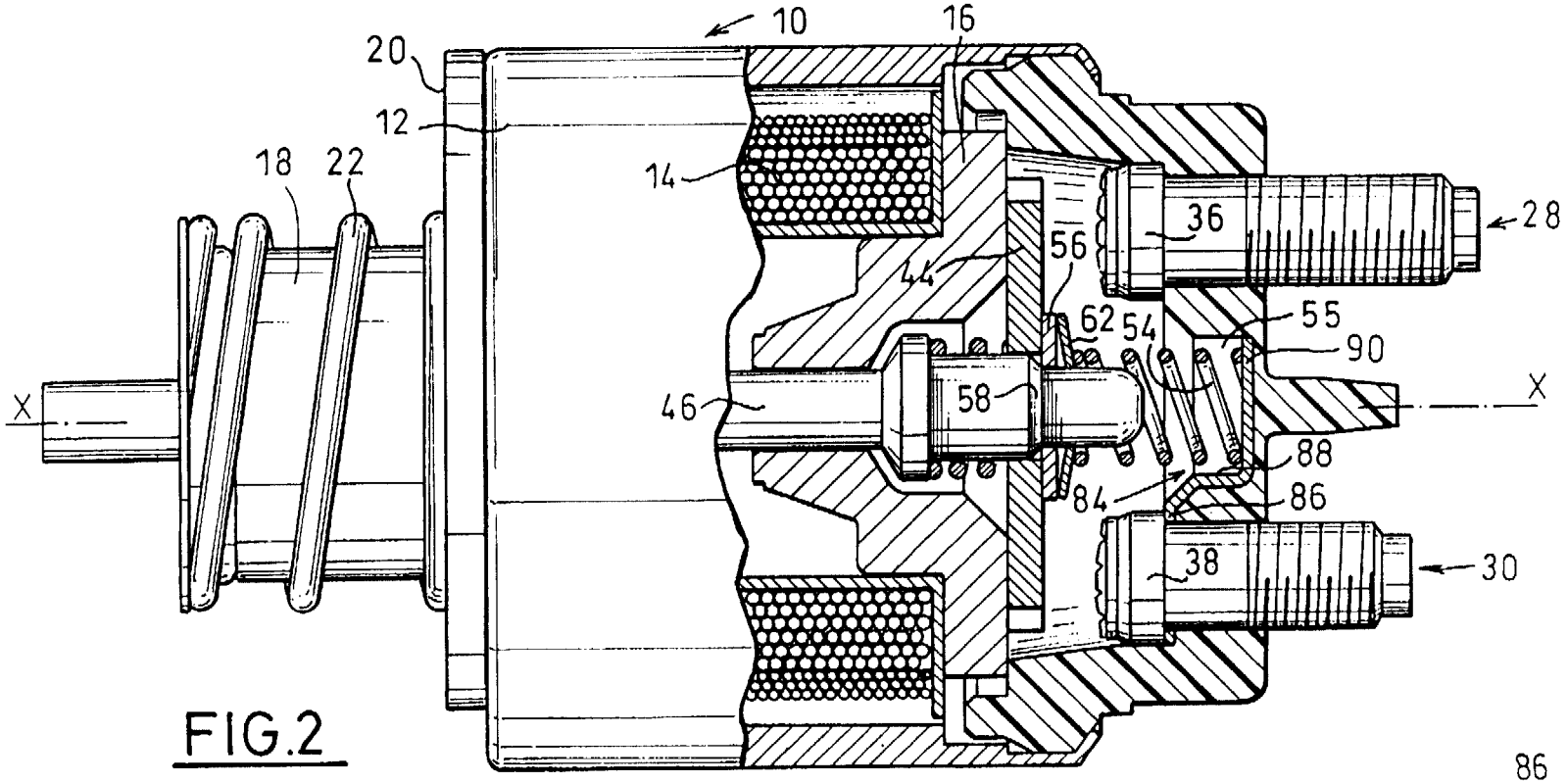
FIG. 2 is a view similar to that of FIG. 1 depicting a contactor in accordance with the disclosures of the invention illustrated in the idle position.
Figure 4:
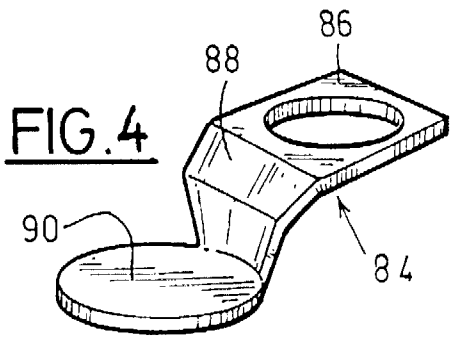
FIG. 4 is a depiction in perspective of a metal connection lug according to the invention.
Figure 3:
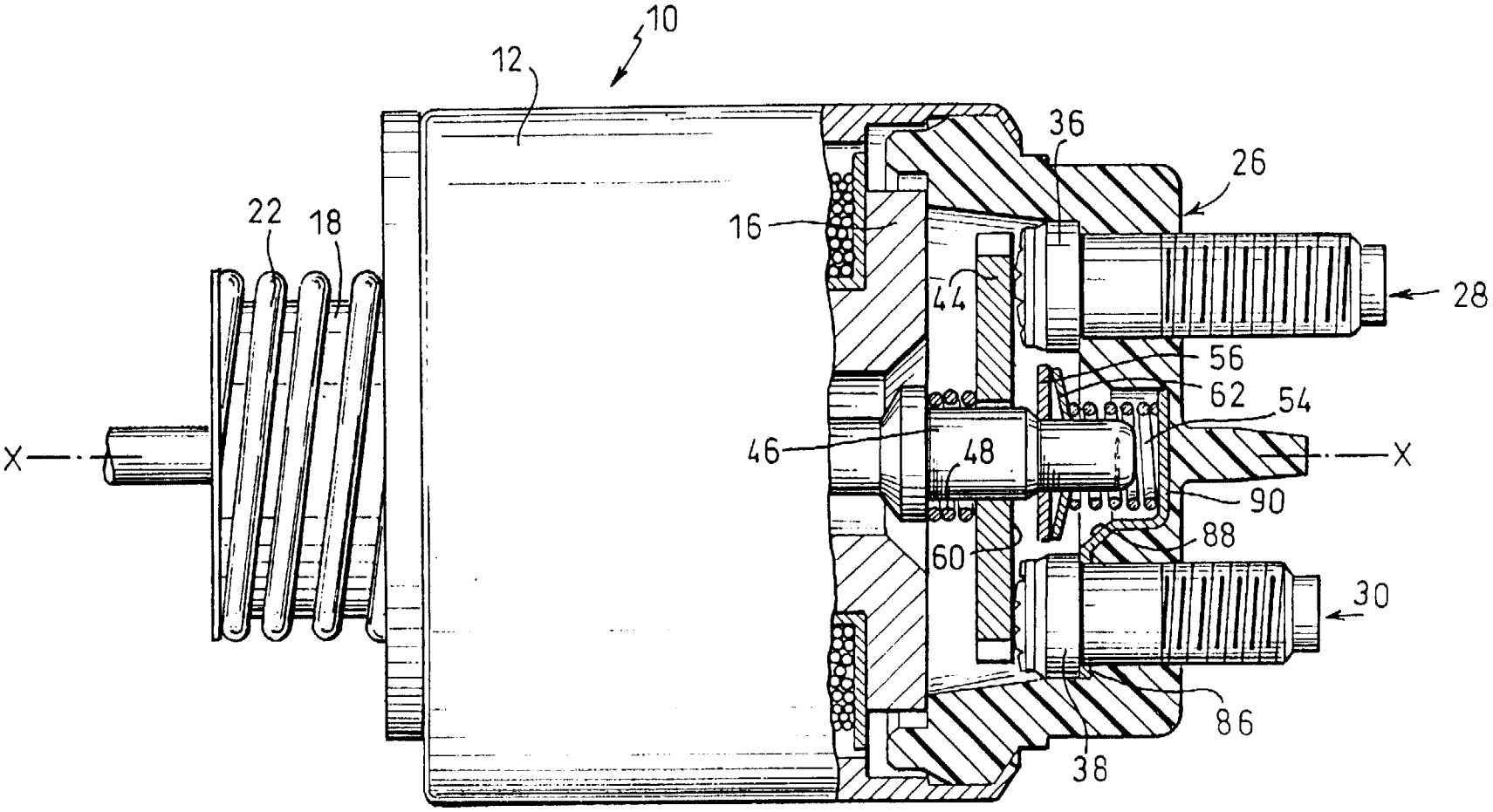
FIG. 3 is a view similar to that of FIG. 2 depicting the contactor according to the invention in the active position.

FIGS. 1 to 3 depict a starter contactor 10 having a cylindrical casing 12 with an axis X—X, in which there is mounted an annular winding 14 which, when it has an energising current passing through it, gives rise in the contactor to an axial magnetic flux, notably by virtue of a pole piece 16, and the winding is then able to give rise to the axial movement of a movable core 18.

The movable core 18 is therefore able to slide between an idle position in which it projects axially through a first axial extremity 20 of the contactor 10, and an active position in which, under the effect of the magnetic field induced by the winding 14, it is almost entirely received within the winding 14.

A helical compression spring 22 elastically returns the movable core 18 to its idle position.

The casing 12 of the contactor 10 is closed at its second opposite axial extremity 24 by a block 26 supporting terminals 28, 30 provided for the electrical supply of the starter motor (not shown).

The support block made of insulating material 26 has a cylindrical annular skirt 32 which enables it to be centered and fixed to the extremity 24 of the casing 12 of the contactor 10, and a transverse bottom 34 which closes the contactor 10 axially.

The terminals 28, 30 are substantially diametrically opposite each other on the bottom 34, on each side of the axis X—X of the contactor 10.

The terminals 28, 30 each have a contact head 36, 38 arranged inside the contactor 10, against the transverse bottom 34 of the support block 26 and a connection stud 40, 42, partly threaded and extending axially through the transverse bottom 34 so as to open out outside the contactor 10.

A first terminal 28 is designed to be connected to the positive terminal (not shown) of an accumulator battery of the vehicle and the second terminal 30 is designed to receive a cable (not shown) supplying the starter motor.

The support block 26 is produced from an insulating material and is fixed, for example by clamping, at the extremity 24 of the contactor 10.

A movable contact 44, formed by a substantially rectangular plate, is able to be moved axially inside the space 45 defined by the annular wall 32 and the bottom 34 of the support block 26, between an idle position in which it bears against the pole piece 16 of the contactor 10 and an active position in which the movable contact 44 bears simultaneously against the heads 36, 38 of the terminals 28, 30 so as to establish between these two terminals 28, 30 an electrical connection which supplies the starter motor with electrical current coming from the accumulator battery of the vehicle.

The axial movement of the movable contact 44 is controlled by a rod 46, which is guided axially in the pole piece 16, and whose movements are controlled by the movable core 18.

In a known manner, the movable contact 44 is mounted so as to slide on the rod 46.

The rod 46 actuates the movable contact 44 to its active position by means of a contact spring 48 which bears on the one hand against a shoulder 50 on the rod 46 and on the other hand against the axial face 52 of the movable contact 44 which bears against the pole piece 16 when the contact 44 is in the idle position.

This structural arrangement, combined with the mounting with radial clearance of the movable contact 44 on the rod 46, allows a slight pivoting of the movable contact 44 and thereby ensures perfect electrical contact against the heads 36, 38 of the terminals 28, 30, even if these should exhibit unequal wear.

A return spring 54 returns the rod 46 and the movable contact 44 to the idle position.

The return spring 54 bears against the bottom of a cylindrical housing 55 arranged at the center of the transverse bottom 34 of the block 26 and elastically pushes a metal washer 56 which bears against a second shoulder 58 on the rod 46 and against the axial face 60 of the movable contact, which also cooperates with the terminals 28, 30.

The metal washer 56 is fixed axially on the rod 46 against the shoulder 58 by a clawed washer 62 which is forcibly fitted onto the axial extremity 64 of the control rod 46.

FIG. 1 depicts more particularly a known embodiment of a contactor which is used to connect the supply terminal 38 to the electrical earth of the vehicle through the movable contact 44.

To this end, a component 66 made of cut-out and folded sheet metal is provided which has an extremity 68 interposed between the contact head 38 of the terminal 30 and the transverse bottom 34, which has a connection strip 70 which extends axially along the internal face 72 of the annular wall 32 of the support block 26, and which has a second extremity 74 curved radially inwards.

The second curved radial extremity 74 is designed to cooperate with the face 52 of the movable contact 44 when it is also making contact with the pole piece 16.

The lug 66 being in continuous contact with the supply terminal 30, it has a high electrical potential when the movable contact 44 establishes contact between the two terminals 28, 30.

Any contact between the curved extremity 74 of the lug 66 and the pole piece 16 which is connected to the electrical earth of the vehicle must therefore be avoided.

To this end, an insulation plate 76 made of an insulating material has been provided between the curved extremity 74 and the pole piece 16.

This plate 76 has at its center a hole 78 for the passage of the control rod 46 and it also includes a perforation 80 through which there extends axially a protuberance 82 on the pole piece 16 designed to make contact with the face 52 of the movable contact 44.

The protuberance 82 is situated transversely in the same plane as the curved extremity 74 of the lug 66 so as to enable the movable contact to bear, in the idle position, simultaneously against the protuberance 82 of the pole piece 16 and against the curved part 74 of the lug 66 so as to produce the electrical connection between the supply terminal 30 and the electrical earth of the vehicle.

This arrangement presents numerous drawbacks.

This is because it is necessary to use an insulation plate 76, otherwise electric arcs may appear between the extremity 74 of the lug 66 and the pole piece 16.

Moreover, the curved extremity 74 which extends radially inward prevents simple assembly by axial stacking of the various elements.

Furthermore, this arrangement necessitates the production of a protuberance 82 in the pole piece 16, which entails indexing during assembly so as to position it facing the perforation 80 in the insulating plate 76, which affords only a very limited contact surface between the movable contact 44 and the pole piece 16.

In accordance with the disclosures of the invention, the starter contactor depicted in FIGS. 2 and 3 enables an electrical earthing of the supply terminal 30 of the contactor by means of the return spring 54.

To this end, a metal lug 84 having an extremity 86 interposed between the head 38 of the strip 30 and the transverse bottom 34, a connection strip 88 and an extremity 90 which extends to the bottom of the cylindrical housing 55 for guiding the return spring 54 arranged in the transverse bottom 34.

In the idle position of the movable contact 44, as can be seen in FIG. 2, the electrical connection is thus produced between the supply terminal 30 and the pole piece 16 which is earthed to the electrical earth of the vehicle by means of the lug 84, the return spring 54, the metal washers 62, 56 and through the movable contact 44.

When the starter is operated by the driver, the movable contact 44 is pushed by the control rod 46 to its active position, as depicted in FIG. 3 and in which the movable contact 44 bears through its axial face 60 against the terminals 28, 30.

The movable contact 44 being pushed against the contact heads 36, 38 by the contact spring 48 connected to the rod 46, the rod 46 has an axial movement travel greater than that of the movable contact 44.

Thus, when the movable contact makes contact with the terminals 28, 30, the rod 46 continues its movement from left to right as seen in the figure, so as to compress the contact spring 48, which causes the breaking of the contact between the metal washer 46 and the movable contact 44.

Thus, as soon as there is contact between the movable contact 44 and the terminals 28, 30, the electrical connection between the movable contact and the supply terminal 30 is interrupted, thereby preventing an excessively high current passing through the lug 84, return spring 54, metal washer 56 and fixing washer 62, which are not designed to transmit large currents.

I claim:

1. A starter for a motor vehicle, of the kind having a contactor provided with a movable contact capable of being moved in translation by electromagnetic means between an idle position, in which the contact bears against a fixed conductive element connected to the electrical earth of the vehicle, and towards which it is forced by elastic return means, and an active position in which the movable contact establishes the electrical connection between a current input terminal, connected to the positive terminal of the battery of the vehicle, and a terminal supplying the starter motor, of the kind in which means are provided which, when the movable contact is in the idle position, enable an electrical contact to be established between the supply terminal and the electrical earth of the vehicle through the movable contact, and of the kind in which the elastic return means between the movable contact and a support block for the terminals which is made from an insulating material, the movable contact and the supply terminal being connected electrically by elastic return means made of a conductive material;

wherein the elastic return means include a helical compression spring made of a conductive material bearing through a first axial extremity against the movable contact and through its second extremity against a metal electrical connection lug connected to the supply terminal;

wherein the contactor has a substantially cylindrical casing, closed off at one axial extremity by the support block for the terminals which has an annular skirt for centering and fixing onto the casing and a transverse bottom, wherein each of the terminals has a contact head arranged against the transverse bottom and a connection stud which opens axially into the external face of the transverse bottom, wherein the spring is arranged axially in the contactor and wherein it is guided at its second axial extremity in a substantially cylindrical housing formed substantially at the center of the transverse bottom; and wherein the metal lug has a first extremity which is received in the housing and against which the second extremity of the return spring bears axially, and a second extremity which is connected to the first by a bent connection strip, which has a hole in it for the passage of the connection stud of the supply terminal, and wherein the second extremity if clamped between the contact head of the supply terminal and the internal face of the transverse bottom of the block.

* * * * *